US008485923B2

(12) United States Patent
Kozlik et al.

(10) Patent No.: US 8,485,923 B2
(45) Date of Patent: Jul. 16, 2013

(54) APPARATUS AND METHOD FOR ATTACHING VANE TO SHAFT

(75) Inventors: Christopher A. Kozlik, Schaumburg, IL (US); Michael M. Czemske, Lyons, IL (US); Greg Smith, Geneva, IL (US)

(73) Assignee: New Archery Products Corp., Forest Park, IL (US)

( * ) Notice: Subject to any disclaimer, the term of this patent is extended or adjusted under 35 U.S.C. 154(b) by 412 days.

(21) Appl. No.: 12/924,134

(22) Filed: Sep. 21, 2010

(65) Prior Publication Data

US 2011/0015009 A1 Jan. 20, 2011

Related U.S. Application Data

(63) Continuation-in-part of application No. 12/006,927, filed on Jan. 7, 2008, now abandoned.

(51) Int. Cl.
*F42B 6/06* (2006.01)

(52) U.S. Cl.
USPC ..... 473/586

(58) Field of Classification Search
USPC ..... 473/578, 585, 586
See application file for complete search history.

(56) References Cited

U.S. PATENT DOCUMENTS

| | | | |
|---|---|---|---|
| 219,881 | A | 9/1879 | Streeter |
| 2,193,397 | A | 3/1940 | Dykes |
| 2,277,743 | A | 3/1942 | Crossman |
| 2,525,332 | A | 10/1950 | Alger et al. |
| 2,782,036 | A | 2/1957 | Folberth et al. |
| 2,830,818 | A | 4/1958 | Otto |
| 2,887,319 | A | 5/1959 | Lay |
| 2,899,773 | A | 8/1959 | Lockwood |
| 2,976,042 | A | 3/1961 | Barnett |
| 3,106,400 | A | 10/1963 | Zwickey |
| 3,539,187 | A | 11/1970 | Smith |
| 3,595,579 | A | 7/1971 | Benoit |
| 3,596,910 | A | 8/1971 | Rizzo |
| 3,672,677 | A | 6/1972 | Moore |
| 3,672,678 | A | 6/1972 | Rizzo |
| 3,749,403 | A | 7/1973 | Austin et al. |
| 3,756,602 | A | 9/1973 | Carella |
| 3,815,916 | A | 6/1974 | Meszaros |

(Continued)

FOREIGN PATENT DOCUMENTS

| | | |
|---|---|---|
| JP | 2003-21499 | 1/2003 |

OTHER PUBLICATIONS

Rouge, Dave: U.S. Provisional Patent Application entitled: Arrow Fletch Device, U.S. Appl. No. 60/533,039 (4 pages), Filed Dec. 29, 2003.

(Continued)

*Primary Examiner* — John Ricci
(74) *Attorney, Agent, or Firm* — Pauley Petersen & Erickson

(57) ABSTRACT

A method for attaching a vane with respect to a shaft of an arrow or a crossbow bolt. The vane is attached to a tube or sleeve that is positionable over an outer surface of the shaft. The sleeve has an inner surface and the shaft has an outer surface. In an attached position of the vane with respect to the shaft, an adhesive is sprayed onto the inner surface or is otherwise positioned between and contacts at least a portion of the inner surface of the sleeve and at least a portion of the outer surface of the shaft.

20 Claims, 4 Drawing Sheets

U.S. PATENT DOCUMENTS

| | | | |
|---|---|---|---|
| D232,356 | S | 8/1974 | Melton et al. |
| 3,853,320 | A | 12/1974 | Carella |
| 3,897,062 | A | 7/1975 | Christensen |
| 3,982,762 | A | 9/1976 | Milicic |
| 4,003,576 | A | 1/1977 | Carella |
| 4,012,043 | A | 3/1977 | Carella |
| 4,088,323 | A | 5/1978 | Munger |
| 4,204,307 | A | 5/1980 | Pfetzing |
| 4,234,192 | A | 11/1980 | Salamone |
| 4,266,782 | A | 5/1981 | Patterson |
| 4,392,654 | A | 7/1983 | Carella |
| 4,400,498 | A | 8/1983 | Konishi et al. |
| 4,477,084 | A | 10/1984 | Austin |
| 4,488,728 | A | 12/1984 | Humphrey |
| 4,502,692 | A | 3/1985 | Humphrey |
| 4,510,109 | A | 4/1985 | Carella |
| 4,534,568 | A | 8/1985 | Tone |
| 4,565,377 | A | 1/1986 | Troncoso, Jr. et al. |
| 4,583,745 | A | 4/1986 | Ladner |
| 4,615,552 | A | 10/1986 | Bengtson |
| 4,986,550 | A | 1/1991 | Segovia |
| 5,024,448 | A | 6/1991 | Barrie |
| 5,039,110 | A | 8/1991 | Honda |
| 5,064,202 | A | 11/1991 | Barner |
| 5,112,062 | A | 5/1992 | Pratt |
| 5,119,797 | A | 6/1992 | Anderson |
| 5,213,090 | A | 5/1993 | Tone |
| 5,257,809 | A | 11/1993 | Carrizosa |
| 5,311,855 | A | 5/1994 | Basik |
| 5,427,385 | A | 6/1995 | Conrad et al. |
| 5,439,231 | A | 8/1995 | Roberts et al. |
| 5,443,272 | A | 8/1995 | Vincent, Sr. |
| 5,443,273 | A | 8/1995 | Lovorn |
| 5,465,981 | A | 11/1995 | Klaus |
| 5,613,688 | A | 3/1997 | Carella |
| 5,842,942 | A | 12/1998 | Doht et al. |
| 5,846,147 | A | 12/1998 | Basik |
| 5,871,410 | A | 2/1999 | Simo et al. |
| 5,897,449 | A | 4/1999 | Roberts et al. |
| 5,951,419 | A | 9/1999 | Cameneti |
| 6,014,931 | A | 1/2000 | Fromson et al. |
| 6,142,896 | A | 11/2000 | Simo et al. |
| 6,203,457 | B1 | 3/2001 | Snook |
| 6,220,978 | B1 | 4/2001 | Schroeder |
| 6,319,161 | B1 | 11/2001 | Martinez et al. |
| 6,390,642 | B1 | 5/2002 | Simonton |
| 6,496,373 | B1 | 12/2002 | Chung |
| 6,641,493 | B1 | 11/2003 | Shifflett |
| 6,663,518 | B1 | 12/2003 | Kuhn |
| 6,695,727 | B1 | 2/2004 | Kuhn |
| 7,074,143 | B2 | 7/2006 | Czemske et al. |
| 7,485,057 | B2 * | 2/2009 | Afshari ..... 473/586 |
| 2002/0028718 | A1 | 3/2002 | Coe |
| 2002/0151394 | A1 | 10/2002 | Arasmith |
| 2005/0178375 | A1 | 8/2005 | Sutherland |

OTHER PUBLICATIONS http://www.arrowwraps.com; Bay Wholesalers:Preston Performance—Graphics n Sign—printed on Jul. 12, 2004 (2 pages).

http://www.decalnetwork.com/awinstall.htm; Bay Wholesalers:Preston Performance—Graphics n Sign—printed on Jul. 12, 2004 (1 page).

Cabela's Catalogue: (3 pages).

http:// www.extremearchery.com/shrink_fletch.html, Extreme Archery Products, "Shrink Fletch", published Mar. 27, 2005 (2 pages) and pictured contents of "Shrink Fletch" package (1 page).

Shootingmasters, Arrow-Skin™ Packaging Insert (3 pages) available prior to Jan. 7, 2007.

http://www.shootingmasters.com, Shootingmasters, "About Arrow-Skin™" internet information page, Copyright © 2001 (1 page).

http://www.shootingmasters.com, Shootingmasters, "Installing Arrow-Skins™" internet instruction page, Copyright © 2001 (2 pages).

http://www.shootingmasters.com, Shootingmasters, "On-Line Arrow-Skin Ordering", Internet order form page, Copyright © 2004 (2 pages).

http://www.shootingmasters.com, Shootingmasters, "Arrow-Skin™ Home Page", Copyright © 2001(1 page).

http://www.shootingmasters.com, Shootingmasters, "Arrow-Skin™ Tips", Copyright © 2001 (1 page).

https://www.shootingmasters.com, Shootingmasters, Arrow-Skin™ "Photo Image Page" and photo enlargement, Copyright © 2001 (2 pages).

* cited by examiner

APPARATUS AND METHOD FOR ATTACHING VANE TO SHAFT

This application is a Continuation-in-Part of application Ser. No. 12/006,927, filed Jan. 7, 2008 now abandoned.

BACKGROUND OF THE INVENTION

1. Field of the Invention

This invention relates to an apparatus and a method for securing a vane, such as an archery vane or a crossbow vane, to a shaft, such as an arrow shaft or a crossbow shaft. This invention also relates to an apparatus and a method for displaying an image, such as on a fletching system.

2. Discussion of Related Art

Known production methods for securing or attaching an archery vane to an arrow shaft can be time-consuming and expensive. When an archery vane is detached from an arrow shaft, it is difficult for an archer to repair or replace one or more archery vanes, particularly when each vane is precisely positioned with respect to each other or with respect to a longitudinal axis of the arrow shaft.

In order to maintain arrow dynamic flight characteristics of an archery arrow, it is important to maintain the precise position of the archery vane with respect to the arrow shaft. Thus, fletching systems or cartridges have been developed to simplify assembly in both the field and in the manufacturing facility.

For example, Czemske et al., U.S. Pat. No. 7,074,143 discloses a fletching system that has a sleeve which can be positioned about an outer surface of an arrow shaft, wherein at least one archery vane is mounted to an outer surface of the sleeve. The sleeve can have shrink-fit characteristics that allow the sleeve to shrink, for example when heat is applied to the sleeve. The sleeve can also be adhesively secured to the arrow shaft.

One problem with some heat shrinkable materials is that they have a relatively low coefficient of friction. For aerodynamic reasons, many arrow shafts have an outer surface with a relatively low coefficient of friction. Even if the heat shrinkable material is tightly shrunk about an outer surface of the arrow shaft, because the sleeve and the shaft each has a relatively low coefficient of friction, the sleeve can still move relative to the arrow shaft when a force is applied. For example, an archer will often grasp and pull the fletching when removing an arrow from a target. Often, the pulling force will cause the vane assembly or sleeve to pull away from the arrow shaft, leaving the arrow shaft and the arrowhead in the target and undesirably separating the sleeve and vanes from the arrow shaft.

In attempts to overcome this problem, it is known to apply an adhesive or a glue between an inner surface of the sleeve and an outer surface of the arrow shaft. However, many glues are unable to withstand the forces applied when an archer removes an arrow shaft from a target. Even with an adhesive or glue, the fletching system undesirably separates from the arrow shaft.

It is known to apply an image to an exterior surface of an arrow or an arrow component. However, the applied image is normally exposed at the exterior surface and thus experiences frictional wear, such as when the arrow is used, during flight and/or during target penetration. Thus, there is a need for an apparatus and a method for applying an image, particularly one that reduces or eliminates frictional wear on or to the image.

SUMMARY OF THE INVENTION

It is one object of this invention to provide an method and a method for securing a fletching system or sleeve with respect to an arrow shaft.

The above and other objects of this invention can be accomplished with a phase change adhesive or another suitable phase change material that is positioned between an inner surface of the sleeve and an outer surface of the arrow shaft. The phase change adhesive can provide a relatively high bonding strength or a sufficient bond between the sleeve and the arrow shaft, particularly when a surrounding environment is within a set range of temperatures. The bonding strength of the phase change adhesive can be selected or designed to withstand undesirable forces applied, for example when an archer removes an arrow from a target.

When removing or changing a fletching system, the phase change adhesive can be heated, for example, to above a set range of temperatures, to lessen the bonding strength of the adhesive between the sleeve and the arrow shaft. Thus, an archer can simply heat and then remove a fletching system or sleeve from the arrow shaft, particularly so that one or more vanes can be replaced while reusing the arrow shaft.

The phase change adhesive can also better resist relatively cold temperatures, particularly at which other adhesives or glues become brittle and/or easily lose adhesive properties. With a fletching system according to this invention, an archer can conveniently and quickly remove and replace a damaged or otherwise undesired fletching system from the arrow shaft.

In other embodiments according to this invention, a tube or sleeve of a fletching system is expanded from a collapsed form prior to attaching a vane to the expanded tube or sleeve. The expanded tube or sleeve can then be formed into a pre-shrink shape that prevents the expanded tube from re-collapsing on itself, which can be helpful when positioning and securing the tube or sleeve on or about a shaft of an arrow or a bolt.

BRIEF DESCRIPTION OF THE DRAWINGS

The drawings show different features of this invention, wherein.

DETAILED DESCRIPTION OF THE INVENTION

Many features and elements of this invention are similar to and further described by Czemske et al., U.S. Pat. No. 7,074,143. The entire teachings of U.S. Pat. No. 7,074,143 are incorporated into this specification by reference to U.S. Pat. No. 7,074,143.

Figure 1:
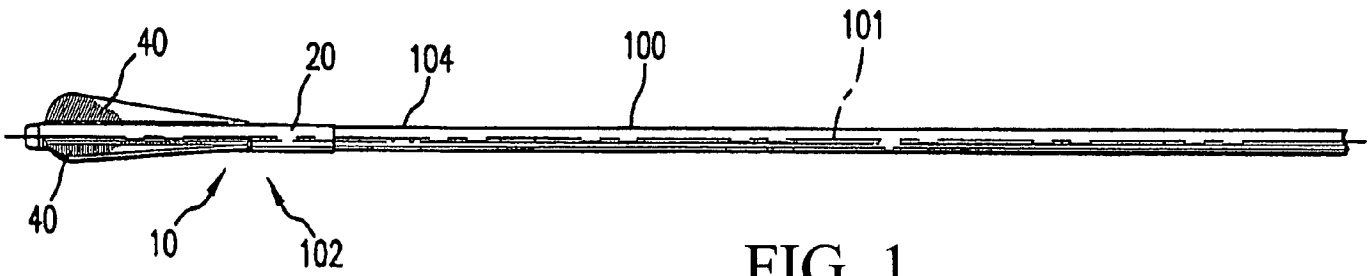
FIG. 1 is a side view of an aft end portion of an arrow shaft having a fletching system secured about the arrow shaft, according to one embodiment of this invention.
Figure 2:
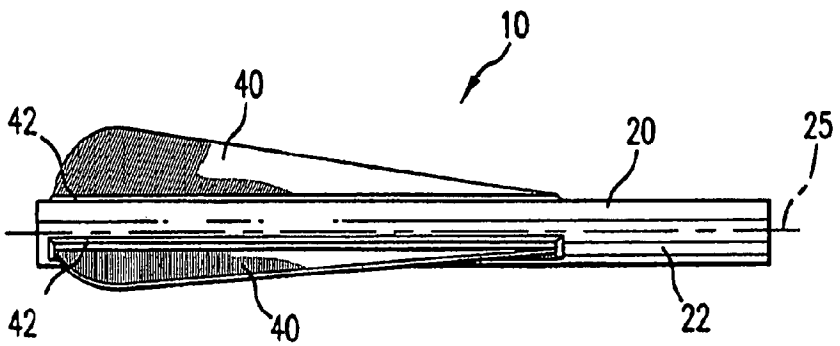
FIG. 2 is a side view of a fletching system, according to one embodiment of this invention.

FIG. 1 shows fletching system 10 which comprises sleeve 20 that is positionable about outer surface 104 of arrow shaft 100. Fletching system 10 and/or vane 40 of this invention can be used with an archery arrow or with a crossbow bolt. In some embodiments of this invention, sleeve 20 is made of a suitable shrinkable material, such as a heat shrinkable material, or another similar material. Thus, sleeve 20 can be positioned relative to arrow shaft 100 and then heat can be applied to sleeve 20 to secure sleeve 20 with respect to arrow shaft 100. As used throughout this specification and in the claims, the term sleeve and the term tube are intended to be interchangeable with each other and are intended to relate to a structure that can be positioned over, around and/or about arrow shaft 100. Further details of the method and method associated with this structural arrangement are similar to those taught by U.S. Pat. No. 7,074,143.

U.S. Pat. No. 7,074,143 further teaches that sleeve 20 can be adhesively secured to arrow shaft 100. However, some heat shrinkable materials have a relatively low coefficient of friction and thus when used in combination with arrow shaft 100 having a relatively low coefficient of friction, sleeve 20 can undesirably slide, rotate or otherwise move with respect to arrow shaft 100.

To overcome the undesirable movement, it is known to position a glue or an adhesive between inner surface 21 of sleeve 20 and outer surface 104 of shaft 100. However, some conventional adhesives have such a high bonding strength that an adhesive bond cannot be broken to release fletching system 10 or sleeve 20, for example to replace a damaged or worn vane 40. Other conventional adhesives become brittle or otherwise fail in extreme weather conditions, including relatively cold environments and relatively wet or dry environments.

Figure 3:
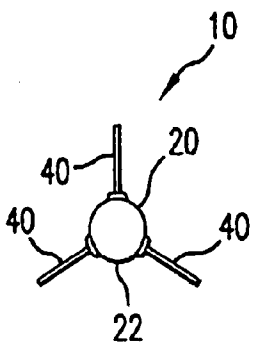
FIG. 3 is a front view of the fletching system as shown in FIG. 2.
Figure 5:
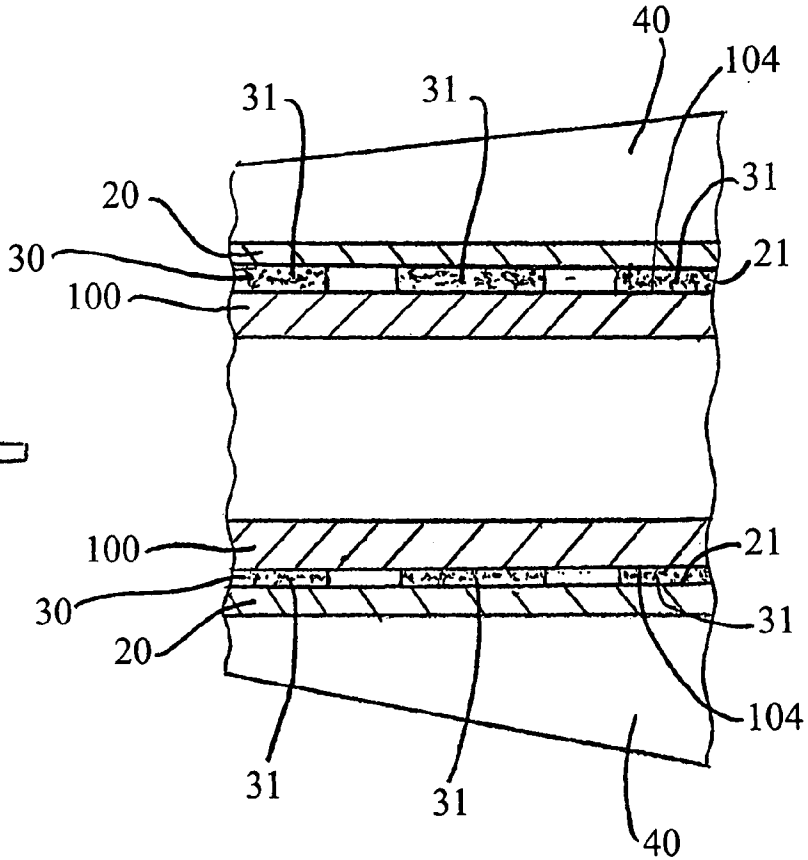
FIG. 5 is a sectional view, taken along line 5-5, as shown in FIG. 4.
Figure 4:
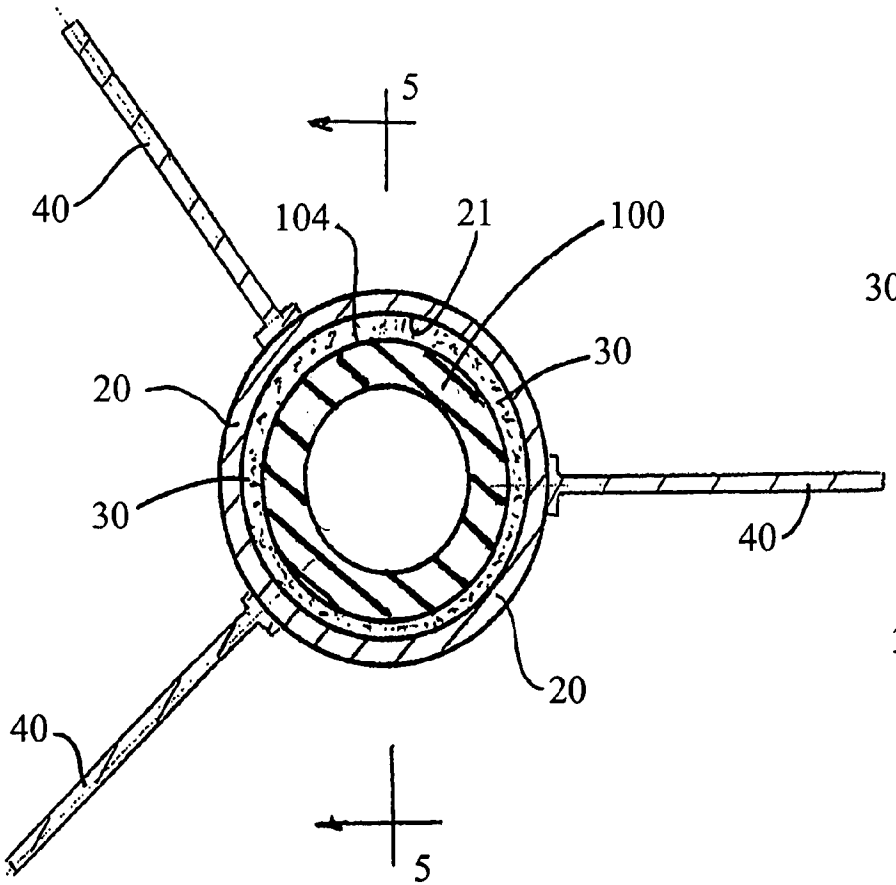
FIG. 4 is a sectional view taken through a section of a fletching system, according to one embodiment of this invention.

FIG. 3 shows fletching system 10 in an unattached or disassembled state, with respect to shaft 100. FIGS. 4 and 5 show fletching system 10 in an attached or assembled state, with respect to shaft 100.

As shown in FIGS. 4 and 5, sleeve 20 is mounted about outer surface 104 of shaft 100. In the attached position of vane 40 with respect to shaft 100, such as shown in FIGS. 4 and 5, adhesive 30, such as phase change adhesive 30, can be positioned between inner surface 21 of sleeve 20 and outer surface 104 of shaft 100. FIG. 5 shows phase change adhesive 30 contacting at least a portion of inner surface 21 and at least a portion of outer surface 104. FIG. 5 shows phase change adhesive 30 forming a plurality of contact areas 31, which in some embodiments are separated from each other. FIG. 5 shows each contact area forming band 31 of material of phase change adhesive 30 between the spaces.

As shown in FIGS. 4 and 5, phase change adhesive 30 forms a layer between inner surface 21 and outer surface 104. In certain embodiments of this invention, the layer can be positioned about a periphery of outer surface 104 of shaft 100. In some embodiments of this invention, phase change adhesive 30 comprises any suitable material that changes its physical state, such as a function of different temperatures. U.S. Pat. No. 6,014,931 discloses phase change adhesives, which include thermoplastic and hot melt materials. The entire teachings of U.S. Pat. No. 6,014,931 are incorporated by reference into this specification. Adhesive 30, such as phase change adhesive 30, of this invention can also comprise an aliphatic resin or any other suitable adhesive and/or phase change material that has acceptable bonding properties.

As used throughout this specification and in the claims, the term adhesive and the term phase change adhesive are intended to be interchangeable with each other and are intended to relate to any suitable adhesive, adhesive material and/or adhesive compound that can be applied to the different surfaces described according to this invention, including but not limited to an adhesive that can be sprayed, particularly sprayed in an atomized form and/or through any suitable atomization spray method, onto a surface.

Adhesive 30, such as phase change adhesive 30, of this invention can form a composition that cooperates with or corresponds to properties of material forming heat shrinkable sleeve 20 or any other suitable shrink-fit sleeve. For example, adhesive 30, such as phase change adhesive 30, can harden or soften at any desired temperature or temperature range by adjusting the composition materials and/or other design parameters of adhesive 30, such as phase change adhesive 30. In some embodiments of this invention, adhesive 30 requires heat and/or applied pressure to set or cause the adhesive to adhere to itself, to inner surface 21 and/or to outer surface 104.

In a disassembled state, sleeve 20 can have an inner diameter which is greater than an outer diameter of shaft 100. A tolerance or gap created by the difference in diameters can be used to slide or otherwise move sleeve 20 with respect to shaft 100, such as in a direction along longitudinal axis 101 of shaft 100. Once sleeve 20 is positioned, a temperature of phase change adhesive 30 can be changed so that phase change adhesive 30 flows into position and sleeve 20 can be heated to a shrunken state, such as shown in FIGS. 4 and 5. In the shrunken state, adhesive 30, such as phase change adhesive 30, can provide sufficient holding or bonding strength, for example to resist a pulling force.

Figure 8:
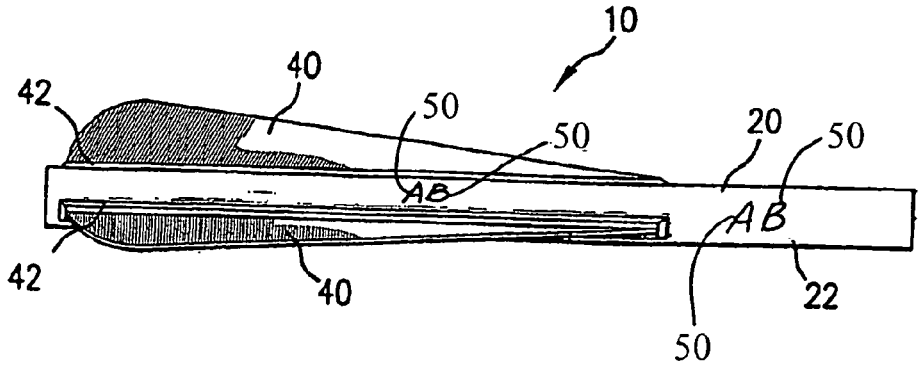
FIG. 8 is a side view of a fletching system, according to another embodiment of this invention.

Tube or sleeve 20 of this invention can be used to mount vane 40 with respect to shaft 100, such as of an arrow and/or a bolt. As shown in FIG. 8, in some embodiments according to this invention, it is possible to apply image 50 so that image 50 appears or is visible when looking at a mounted fletching system 10. In some embodiments of this invention, image 50 is applied to inner surface 21 of tube 20 and can be seen through the material of tube 20, such as a transparent or translucent material. With this arrangement, the ink or other material forming image 50 is not exposed to frictional wear caused by contact between outer surface 22 of tube 20, such as when arrow 100 passes through animal tissue or another target material.

Figure 9:
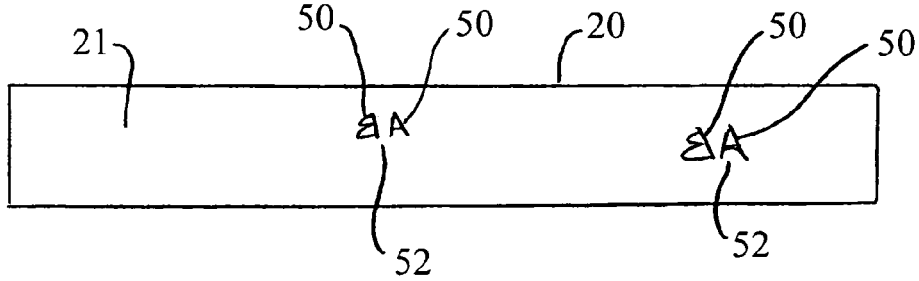
FIG. 9 is a plan view of a flat stock of a shrinkable material, according to one embodiment of this invention.

In some embodiments according to this invention, such as shown in FIG. 9, image 50 is applied to at least a portion of printable surface 52 of a shrinkable material of tube 20. In certain embodiments, printable surface 52 comprises at least a portion of inner surface 21 of tube 20. With image 50 printed on inner surface 21, image 50 can be applied as a reverse image, such as shown in FIG. 9, so that when viewed from outside of tube 20, such as shown in FIG. 8, image 50 will appear normal or true. If image 50 is symmetric about a desired axis, then it is not necessary to apply image 50 as a reverse image to inner surface 21. With image 50 applied to inner surface 21, the material of tube 20 can be transparent, translucent or can have any other feature that allows image 50 to be seen through the material of tube 20.

According to certain embodiments of this invention, adhesive 30 is sprayed onto at least a portion of printable surface 52. Adhesive 30 can cover all or only a portion of image 50 and/or printable surface 52, depending upon a desired design or layout of image 50 and/or printable surface 52. Adhesive 30 can be applied by spraying adhesive 30 onto printable surface 52 and/or inner surface 21 of tube 20. In some embodiments according to this invention, adhesive 30 can be applied as an atomized spray or through an atomization spray method. Adhesive 30 can be applied using a brush, a roller or by any other suitable adhesive application method known to those skilled in the art of adhesives.

Figure 6:
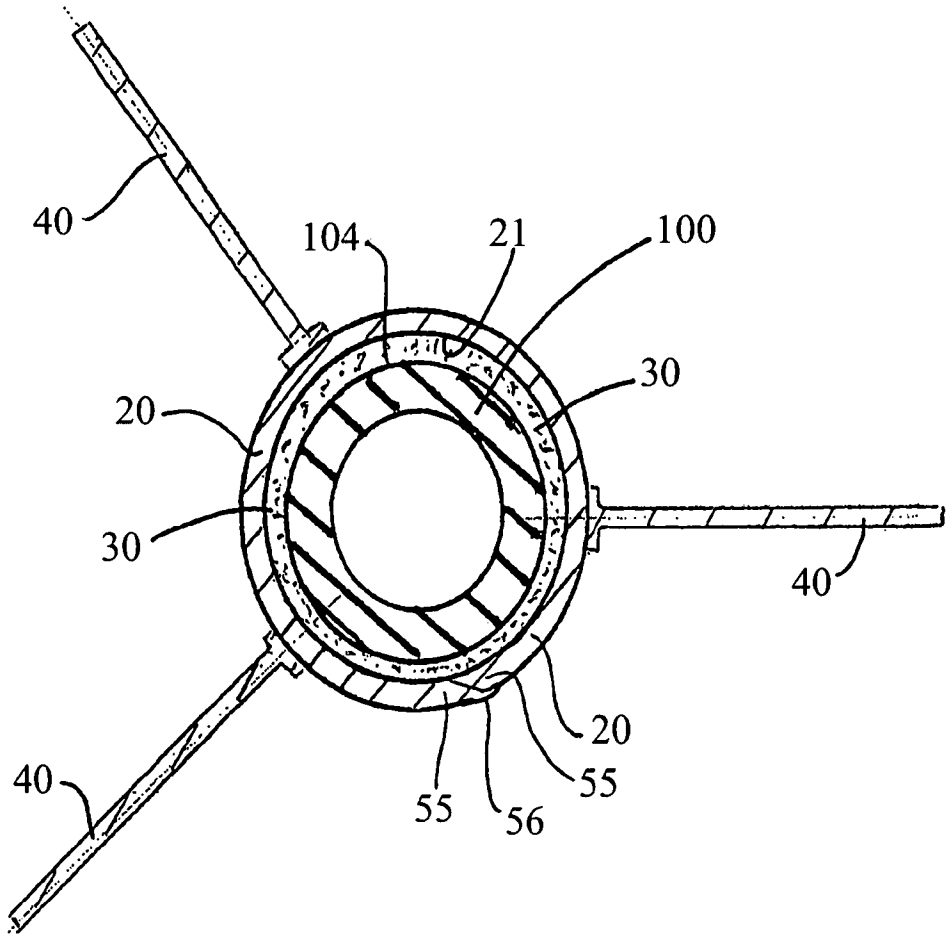
FIG. 6 is a sectional view taken through a section of a fletching system, according to another embodiment of this invention.

In some embodiments according to this invention, at least a portion of the shrinkable material is formed into tube 20. The shrinkable material can be in the form of flat stock, including but not limited to a flat sheet, such as shown in FIG. 9, a rolled flat sheet and/or any other suitable sheet or flat material. In some embodiments of this invention, the flat stock is rolled into tube 20. FIG. 6 shows one embodiment of the flat stock rolled into tube 20, with portions 55 overlapping each other to form lapped seam 56. Any other suitable rolling device or structure can be used to accomplish the same result of forming a shrinkable material into tube 20.

In some embodiments of this invention, vane 40 is attached with respect to, either directly to or in directly to, outer surface 104 of tube 20. Vane 40 can be adhered, welded and/or otherwise mechanically attached or secured to outer surface 104.

Figure 10:
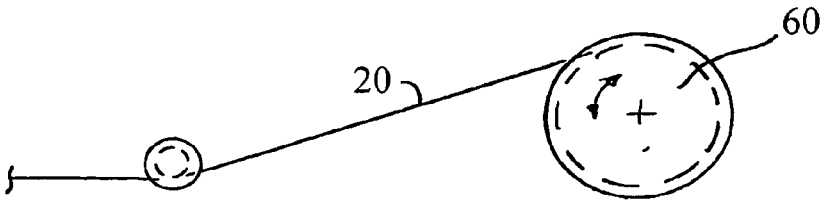
FIG. 10 is a diagrammatic view showing a collapsed tube wound on a storage device, according to one embodiment of this invention.

According to certain embodiments of this invention, the method includes collapsing tube 20. In some embodiments of this invention, tube 20 is collapsed before vane 40 is attached with respect to outer surface 104. As shown in FIG. 10, the collapsed tube 20 can be wound or otherwise gathered onto roll 60 or another suitable take-up or storage device. In some embodiments according to this invention, the collapsed tube 20 is expanded. The expanded tube 20 can be severed, cut or otherwise partitioned into pieces having desired or usable lengths, to correspond to differently sized fletching systems 10 of this invention.

In some embodiments of this invention, the collapsed tube 20 is expanded before vane 40 is attached with respect to outer surface 104. The collapsed tube 20 with the attached vane 40 can be positioned over and secured to outer surface 104 of shaft 100.

Figure 7:
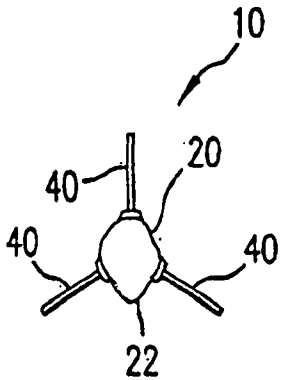
FIG. 7 is a front view of a fletching system showing a non-circular pre-shrink shape of a tube or sleeve according to this invention.

In another method according to this invention, the collapsed tube 20 is expanded into a non-collapsed or expanded tube 20 and vane 40 is attached with respect to outer surface 104. The expanded tube 20 is formed into a pre-shrink or pre-shrunk shape that prevents the expanded tube 20 from re-collapsing. The pre-shrink or pre-shrunk shape is either circular or non-circular, including but not limited to an oval shape, a polygonal shape and/or a generally round shape. FIG. 7 shows one embodiment of a non-circular pre-shrink or pre-shrunk shape. According to some embodiments of this invention, adhesive 30 is then applied to inner surface 21 of the expanded tube 20. The pre-shrink shape of tube 20 can help maintain the shape of the opening through tube 20 and thus prevent inner surface 21 from collapsing on or contacting itself. Because adhesive 30 is applied to inner surface 21, the pre-shrink shape of tube 20 can be used to prevent inner surface 21 from adhering to or sticking to itself rather than to outer surface 104, for example. Also, the composition of adhesive 30 can be selected so that it has relatively low tack properties, so that adhesive 30 does not stick or is prevented from sticking onto itself when tube 20 is collapsed. Adhesive 30 can also be selected so that it is necessary to apply pressure and/or heat to tube 20 to set or adhere the adhesive, so that inner surface 21 of collapsed tube 20 does not stick to itself.

The expanded tube 20 can be positioned over shaft 100, so that the expanded tube 20 can be secured to shaft 100, such as by shrinking the shrinkable material of tube 20. For example, the expanded tube 20 can be secured by exposing the shrinkable material to heat or to another suitable temperature change or difference.

While in the foregoing specification this invention has been described in relation to certain preferred embodiments thereof, and many details have been set forth for purpose of illustration, it will be apparent to those skilled in the art that this invention is susceptible to additional embodiments and that certain of the details described herein can be varied considerably without departing from the basic principles of this invention.

What is claimed is:

1. A method for mounting a vane with respect to a shaft of an arrow and/or a bolt, the method comprising the steps of:

applying an image to a printable surface of at least a portion of a shrinkable material, coating an adhesive onto at least a portion of the printed image and/or the shrinkable material, forming at least a portion of the shrinkable material into a continuous seamed tube with an adhesive coated portion oriented towards an interior of the tube, collapsing the tube into a flattened state, cutting the continuous seamed tube into usable lengths, and attaching the vane with respect to an outer surface of the tube.

2. The method according to claim 1, wherein as the tube is collapsed the adhesive coated portion is prevented from adhering to itself.

3. The method according to claim 1, wherein the collapsed tube is wound into a roll.

4. The method according to claim 1, wherein the collapsed tube is expanded cutting into the usable length.

5. The method according to claim 1, wherein the collapsed tube is expanded before the vane is attached with respect to the outer surface.

6. The method according to claim 1, wherein the tube is secured onto the outer surface of the shaft.

7. The method according to claim 1, wherein the image is applied by printing the image onto the printable surface.

8. The method according to claim 1, wherein the shrinkable material is formed as a flat stock.

9. The method according to claim 8, wherein the flat stock is in a sheet form or a rolled form.

10. The method according to claim 1, wherein an adhesive is atomized when sprayed onto the printable surface.

11. The method according to claim 1, wherein the shrinkable material is formed into the continuous seamed tube by rolling the shrinkable material.

12. The method according to claim 1, wherein overlapping portions of the tube form a lapped seam of the continuous seamed tube.

13. The method according to claim 1, wherein an adhesive is applied over the image.

14. The method according to claim 1, wherein the image is a reverse image.

15. The method according to claim 1, wherein the printable surface is on an inner surface of the tube.

16. A method for mounting a vane with respect to a shaft of an arrow and/or a bolt, the method comprising the steps of:

coating an adhesive onto at least a portion of a shrinkable material, forming at least a portion of the shrinkable material into a continuous seamed tube with an adhesive coated portion oriented towards an interior of the tube, collapsing the tube into a flattened state, cutting the continuous seamed tube into usable lengths, expanding the tube from the flattened state, and attaching the vane with respect to an outer surface of the tube.

17. The method according to claim 16, wherein the expanded tube is positioned over the shaft and the expanded tube is secured to the shaft.

18. The method according to claim 16, wherein the expanded tube is secured to the shaft by exposing the shrinkable material to a temperature change.

19. The method according to claim 16, wherein the adhesive is sprayed onto the inner surface.

20. The method according to claim 16, wherein an image is applied to a printable surface of at least a portion of the shrinkable material.

* * * * *